US011811148B2

(12) United States Patent
Joo et al.

(10) Patent No.: US 11,811,148 B2
(45) Date of Patent: Nov. 7, 2023

(54) PHASED ARRAY ANTENNA

(71) Applicant: AGENCY FOR DEFENSE DEVELOPMENT, Daejeon (KR)

(72) Inventors: Taehwan Joo, Daejeon (KR); Young Dam Kim, Daejeon (KR); Chanho Hwang, Daejeon (KR); Kichul Kim, Daejeon (KR); Kilsoo Jeong, Daejeon (KR); Daehoon Kwon, Daejeon (KR); Jongwoo Seo, Daejeon (KR); Jaesoo Jung, Daejeon (KR)

(73) Assignee: AGENCY FOR DEFENSE DEVELOPMENT, Daejeon (KR)

( * ) Notice: Subject to any disclaimer, the term of this patent is extended or adjusted under 35 U.S.C. 154(b) by 0 days.

(21) Appl. No.: 17/467,122

(22) Filed: Sep. 3, 2021

(65) Prior Publication Data

US 2022/0271424 A1 Aug. 25, 2022

(30) Foreign Application Priority Data

Feb. 22, 2021 (KR) ..... 10-2021-0023527

(51) Int. Cl.
*H01Q 3/32* (2006.01)

(52) U.S. Cl.
CPC ..... *H01Q 3/32* (2013.01)

(58) Field of Classification Search
CPC ..... H01Q 21/20; H01Q 21/205; H01Q 3/32
See application file for complete search history.

(56) References Cited

U.S. PATENT DOCUMENTS

| | | | | |
|---|---|---|---|---|
| 6,774,852 | B2 | 8/2004 | Chiang et al. | |
| 8,179,302 | B2 | 5/2012 | Wajer | |
| 2010/0066590 | A1* | 3/2010 | Brown | G01S 7/03 342/147 |
| 2015/0215011 | A1* | 7/2015 | Hartenstein | H04B 15/00 375/267 |
| 2019/0356055 | A1 | 11/2019 | Saito et al. | |
| 2022/0109237 | A1* | 4/2022 | Hojjat | H01Q 1/523 |

FOREIGN PATENT DOCUMENTS

| | | | | |
|---|---|---|---|---|
| EP | 2857858 | A1 * | 4/2015 | G01S 13/34 |
| JP | 6723382 | | 7/2020 | |
| KR | 10-2005-0084949 | | 8/2005 | |

(Continued)

OTHER PUBLICATIONS

Joo, et al. Design of Tx Multi-Beam Active Phased Array Antenna System for Aerial Communications. The Journal of Korean Institute of Electromagnetic Engineering and Science. 1-10. Published on Apr. 30, 2021, with English translation provided by Google Translate.

(Continued)

*Primary Examiner* — Daniel Munoz
(74) *Attorney, Agent, or Firm* — Ladas & Parry, LLP

(57) ABSTRACT

A phased array antenna includes a transmission unit of a first layer including a plurality of first plates having a polygonal profile, a reception unit of a second layer including a plurality of second plates having a polygonal profile, the reception unit being spaced apart from the transmission unit in a first direction, and a circuit unit arranged within an internal space defined by the transmission unit and the reception unit.

8 Claims, 12 Drawing Sheets

(56) References Cited

FOREIGN PATENT DOCUMENTS

| | | |
|---|---|---|
| KR | 10-2010-0065024 | 6/2010 |
| KR | 10-1489648 | 2/2015 |
| KR | 10-2125886 | 6/2020 |

OTHER PUBLICATIONS

Kim, et al.: Antenna isolation method using sub-array structure with soft-surface for Tx/Rx separated FDD hybrid beamforming system, Journal of Electromagnetic Waves and Applications, DOI: 10.1080/09205071.2020.1848642, published on Nov. 23, 2020.

Office Action dated Feb. 26, 2022 for Korean Patent Application No. 10-2021-0023527 and its English machine translation by Google Translate.

* cited by examiner

PHASED ARRAY ANTENNA

CROSS-REFERENCE TO RELATED APPLICATION

This application is based on and claims priority under 35 U.S.C. § 119 to Korean Patent Application No. 10-2021-0023527, filed on Feb. 22, 2021, in the Korean Intellectual Property Office, the disclosure of which is incorporated by reference herein in its entirety.

BACKGROUND

1. Field

One or more embodiments relate to phased array antennas, and more particularly, to a transception phased array antenna for omnidirectional communication.

2. Description of the Related Art

As surveillance and reconnaissance become important in a recent battlefield environment, long-distance/high-speed wireless communication technology that delivers information collected in hazardous areas must be secured. These wireless communication technologies are generally classified into terrestrial communication networks, satellite communication networks, and public communication networks. Because a terrestrial communication network is subject to geographical constraints and a satellite communication network is affected by the weather and jamming, the use of a public communication network that is easier to secure a line of sight than a terrestrial communication network and more easily increases a transmission speed than a satellite communication network is more required.

In addition, multi-beam antenna technology capable of n (mission device): 1 (repeater) communication is essential to construct a public communication network for supporting a future network-centric operating environment (NCOE).

A conventional public communication network forms a 1:1 public communication node using a directional antenna. This is a method of configuring a 1:1 communication network through a mechanical driving antenna, and thus, a transmit/receive antenna system corresponding to the number of mission devices (e.g., n) is required to support communication of a plurality of mission devices at the same time. In addition, as the antenna system is configured to correspond to the number of mission devices, the size and weight of the system are excessively increased, and thus it is not efficient when the system is mounted at a required position.

Moreover, a conventional phased array antenna for communication generally exhibits a planar array shape, and accordingly, a beam has a limited directivity angle, communication performance deteriorates, and it is difficult to secure omnidirectional connectivity for support communication with a plurality of mission devices present at arbitrary directions.

The technology disclosed in this Background section was already known to the inventors of the disclosure before achieving the disclosure or are technical information acquired in the process of achieving the disclosure. Therefore, it may contain technology that does not form the prior art that is already known in this country to a person of ordinary skill in the art.

PRIOR ART DOCUMENTS

Patent Documents (Patent document 1) JP 6723382

SUMMARY

One or more embodiments include a phased array antenna capable of omnidirectional orientation, miniaturization, and low weight, and having an improved isolation angle.

However, these embodiments are exemplary, and embodiments of the present disclosure are not limited thereto.

Additional aspects will be set forth in part in the description which follows and, in part, will be apparent from the description, or may be learned by practice of the presented embodiments of the disclosure.

According to one or more embodiments, a phased array antenna includes a transmission unit of a first layer including a plurality of first plates having a polygonal profile, a reception unit of a second layer including a plurality of second plates having a polygonal profile, the reception unit being spaced apart from the transmission unit in a first direction, and a circuit unit arranged within an internal space defined by the transmission unit and the reception unit.

Each of the plurality of first plates and the plurality of second plates may include a plurality of radiating elements apart from one another.

The phased array antenna may further include an isolation unit of a third layer including a plurality of third plates having a polygonal profile, arranged between the transmission unit and the reception unit, and including a plurality of protruding walls.

The plurality of protruding walls may have different protrusion lengths from one another.

The plurality of protruding walls may have different separation distances from one another.

The circuit unit may include a plurality of substrates corresponding to the plurality of first plates and the plurality of second plates, and the plurality of substrates may be radially arranged along respective inner sides of the plurality of first plates and the plurality of second plates.

Each of the plurality of substrates may narrow inwards in a radial direction.

Each of the plurality of substrates may have a trapezoidal shape that narrows inwards in the radial direction.

The plurality of substrates may be arranged in a ring shape to define a central space.

According to one or more embodiments, a phased array antenna includes a transceiving unit of a fourth layer including a plurality of fourth plates having a polygonal profile, and a circuit unit arranged within an internal space defined by the transceiving unit.

The circuit unit may include a plurality of substrates corresponding to the plurality of fourth plates, and the plurality of substrates may be radially arranged along respective inner sides of the plurality of fourth plates.

These and/or other aspects will become apparent and more readily appreciated from the following description of the embodiments, taken in conjunction with the accompanying drawings.

BRIEF DESCRIPTION OF THE DRAWINGS

The above and other aspects, features, and advantages of certain embodiments of the inventive concept will be more apparent from the following description taken in conjunction with the accompanying drawings, in which.

DETAILED DESCRIPTION

Figure 1:
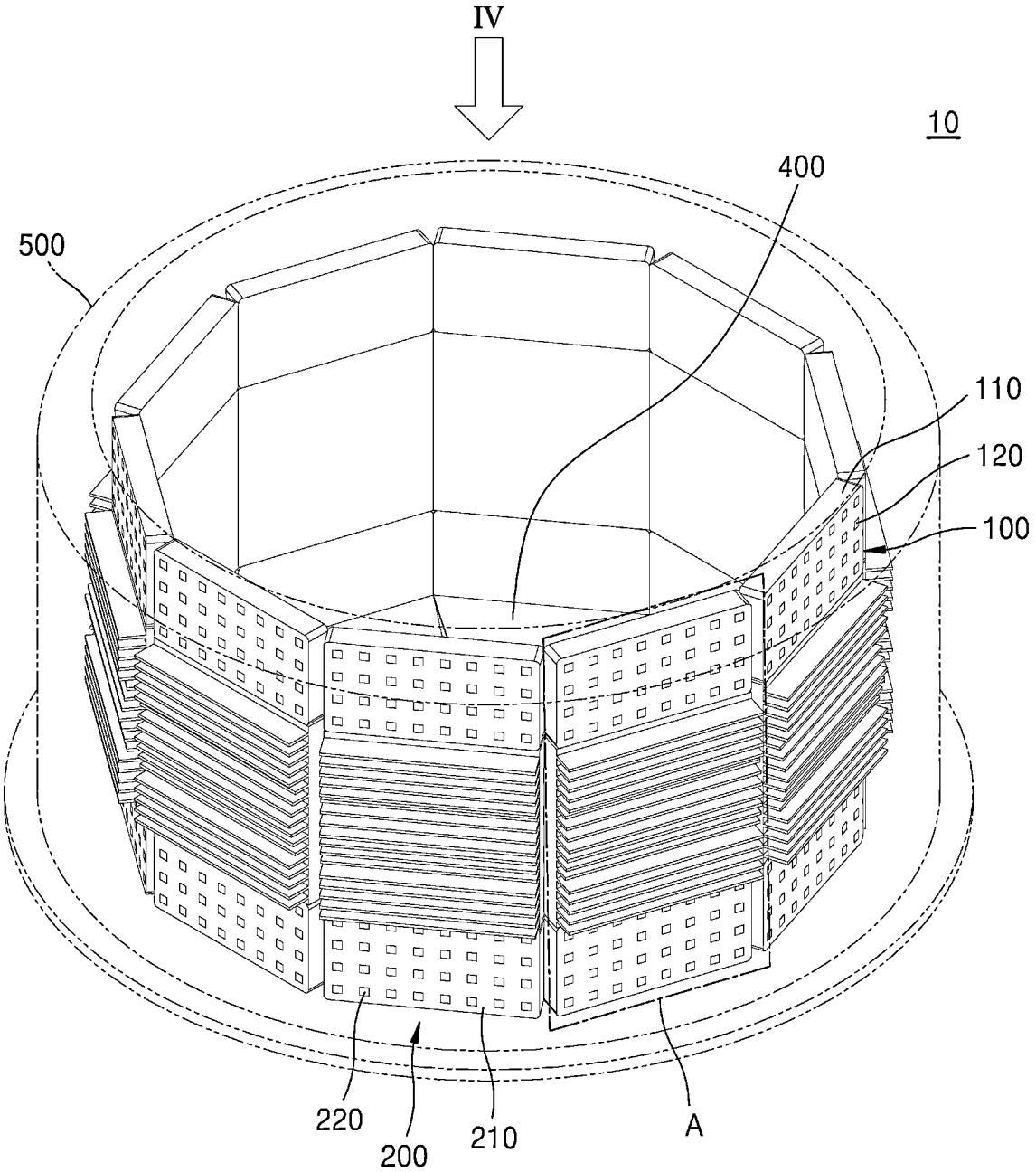
FIG. 1 is a perspective view of a phased array antenna according to an embodiment of the disclosure.

Reference will now be made in detail to embodiments, examples of which are illustrated in the accompanying drawings, wherein like reference numerals refer to the like elements throughout. In this regard, the present embodiments may have different forms and should not be construed as being limited to the descriptions set forth herein. Accordingly, the embodiments are merely described below, by referring to the figures, to explain aspects of the present description. As used herein, the term "and/or" includes any and all combinations of one or more of the associated listed items. Expressions such as "at least one of," when preceding a list of elements, modify the entire list of elements and do not modify the individual elements of the list.

As the disclosure allows for various changes and numerous embodiments, particular embodiments will be illustrated in the drawings and described in detail in the written description. However, this is not intended to limit the disclosure to particular embodiments, and it is to be appreciated that all changes, equivalents, and substitutes that do not depart from the spirit and technical scope of the disclosure are encompassed in the disclosure. In the description of the disclosure, even though shown in other embodiments, the same reference characters or numerals are used for the same components.

Hereinafter, the disclosure will be described in detail by explaining exemplary embodiments of the disclosure with reference to the attached drawings. Like reference numerals in the drawings denote like components, and thus their description will be omitted.

It will be understood that although the terms "first," "second," etc. may be used herein to describe various components, these components should not be limited by these terms. These components are only used to distinguish one component from another.

As used herein, the singular forms "a," "an" and "the" are intended to include the plural forms as well, unless the context clearly indicates otherwise.

It will be further understood that the terms "comprises" and/or "comprising" used herein specify the presence of stated features or components, but do not preclude the presence or addition of one or more other features or components.

Sizes of components in the drawings may be exaggerated for convenience of explanation. In other words, since sizes and thicknesses of components in the drawings are arbitrarily illustrated for convenience of explanation, the following embodiments are not limited thereto.

In the following embodiments, an x-axis, a y-axis, and a z-axis are not limited to three axes on an orthogonal coordinate system, and may be interpreted in a broader sense including them. For example, the x-axis, y-axis, and z-axis may be orthogonal to each other, but may refer to different directions that are not orthogonal to each other.

When a certain embodiment may be implemented differently, a specific process order may be performed differently from the described order. For example, two consecutively described processes may be performed substantially at the same time or performed in an order opposite to the described order.

The terms used in the present specification are merely used to describe particular embodiments, and are not intended to limit the disclosure. In the present specification, it is to be understood that the terms such as "including" or "having," etc., are intended to indicate the existence of the features, numbers, steps, actions, components, parts, or combinations thereof disclosed in the specification, and are not intended to preclude the possibility that one or more other features, numbers, steps, actions, components, parts, or combinations thereof may exist or may be added.

A phased array antenna 10 according to an embodiment of the disclosure will now be described with reference to FIGS. 1 through 4.

Figure 2A:
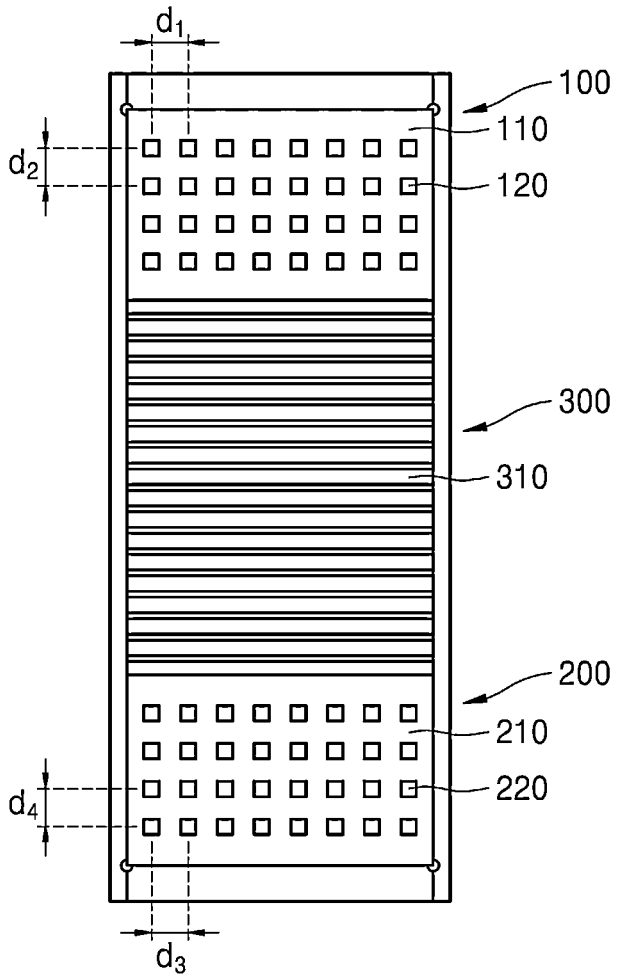
FIGS. 2A, 2B, and 2C are a front view and side views of a region A of FIG. 1.
Figure 2B:
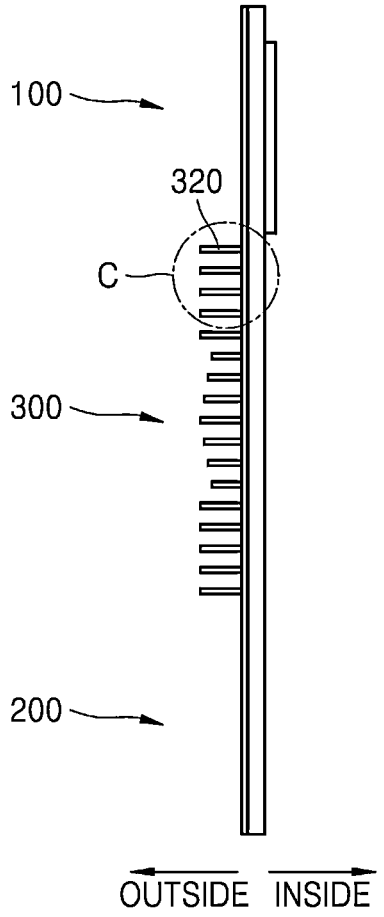
Figure 2C:
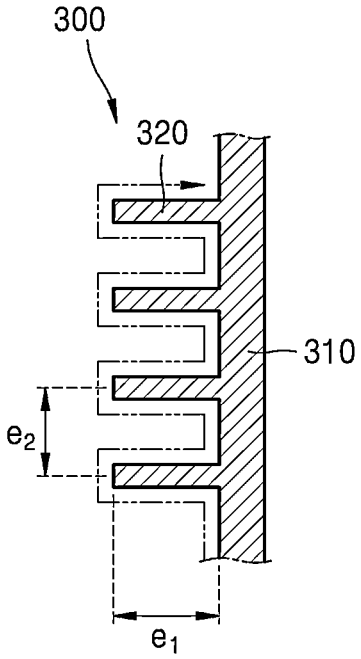
Figure 3:
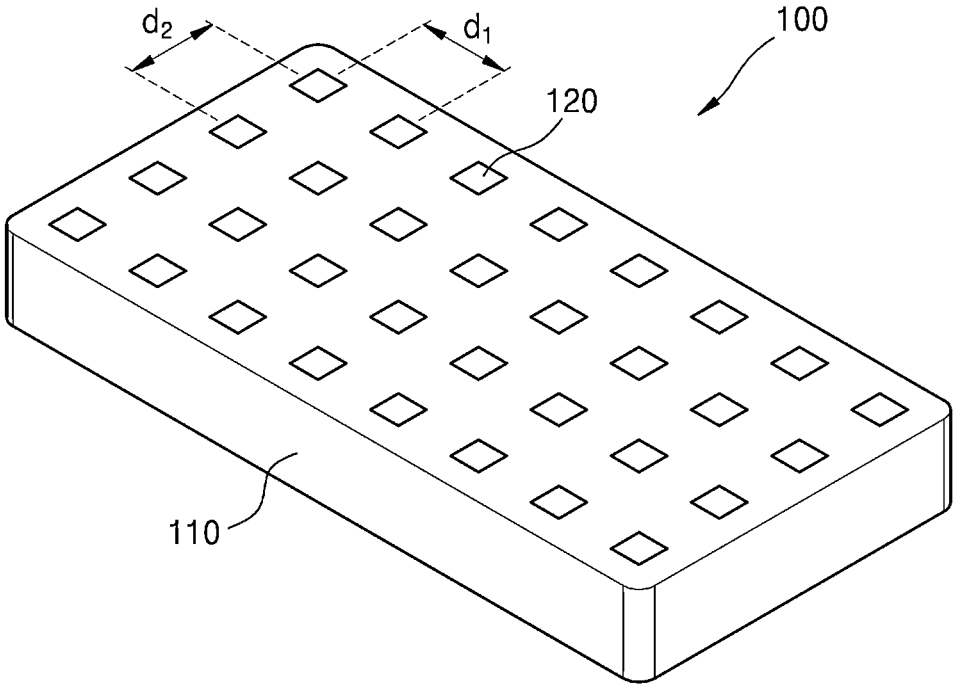
FIG. 3 is a perspective view of a transmission unit according to an embodiment of the disclosure.
Figure 4:
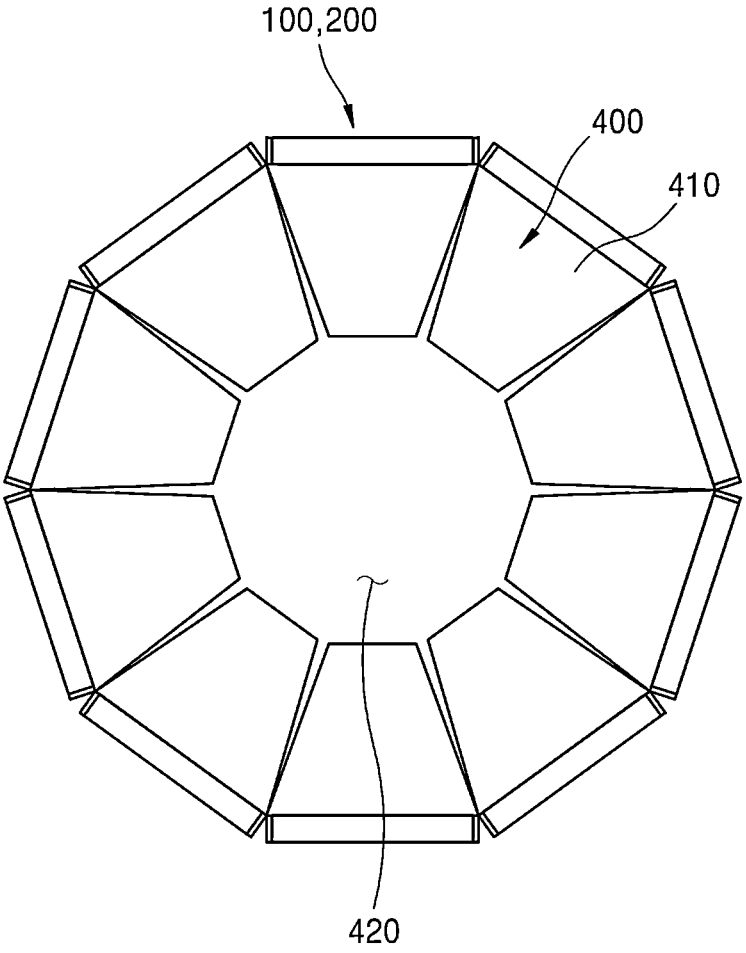
FIG. 4 is a plan view of the phased array antenna according to an embodiment of the disclosure viewed in a direction IV of FIG. 1.

FIG. 1 is a perspective view of the phased array antenna 10 according to an embodiment of the disclosure, FIGS. 2A through 2C are a magnified front view and magnified side views of a region A of FIG. 1, FIG. 3 is a perspective view of a transmission unit 100 according to an embodiment of the disclosure, and FIG. 4 is a plan view of the phased array antenna 10 according to an embodiment of the disclosure viewed in a direction IV of FIG. 1.

Referring to FIG. 1, the phased array antenna 10 may include the transmission unit 100, a reception unit 200, and a circuit unit 400.

In a multi-communication method, a frequency division communication method, which is a communication method for separating frequencies for transmission and reception, and a time division communication method, which is a method for separating a time interval for transmission and reception, are common. The phased array antenna 10 of FIG. 1 is a frequency division communication method, and thus may include the transmission unit 100 and the reception unit 200 separate from each other.

The transmission unit 100 is a member capable of transmitting a signal to a target, and thus may include a plurality of first plates 110. Each of the plurality of first plates 110 may have, but is not limited to, a rectangular shape. According to an embodiment, the first plate 110 may be a reflective plate, and may reflect a signal to orient a beam in a specific direction.

The plurality of first plates 110 are vertically located and arranged as sides of a polygon, and thus, the plurality of first plates 110 may form a polygon, more specifically, a regular polygon. In other words, a profile of the plurality of first plates 110 may form a polygon, more specifically, a regular polygon. The profile of the plurality of first plates 110 may be a tetragon, a hexagon, an octagon, a decagon, or the like, and the number of sides of the polygon may be changed according to the performance of an antenna to be designed.

For convenience of explanation, a case where the profile of the plurality of first plates 110 is a regular decagon as shown in FIG. 1 will now be focused on and described.

The profile of the plurality of first plates 110 forms a polygon, so that the transmission unit 100 may form a space therein and form a first layer configured with the plurality of first plates 110. Here, forming a layer means that plates on the same layer are arranged to be at the same level.

Referring to FIG. 3, each of the plurality of first plates 110 may include a plurality of radiating elements 120 apart from each other. In detail, the plurality of radiating elements 120 may be arranged on one surface of the first plate 110 to be apart from one another in horizontal and vertical directions. In this case, the one surface of the first plate 110, on which the plurality of radiating elements 120 are arranged, may be a surface that faces outside in a radial direction.

Accordingly, the first plate 110 of the transmission unit 100 may transmit a signal toward the outside in the radial direction. Because the plurality of first plates 110 form a polygonal profile and each of the first plates 110 transmits a signal toward the outside in the radial direction, omnidirectional transmission of 360° may be possible. In addition, because only one phased array antenna 10 is needed without requiring a plurality of antenna devices for omnidirectional communication, the efficiency of an arrangement space may be improved.

The plurality of radiating elements 120 may be apart from one another by an interval d1 in a horizontal direction and an interval d2 in a vertical direction. The plurality of radiating elements 120 may form rows and columns by being apart from one another by the interval d1 in the horizontal direction and the interval d2 in the vertical direction. For example, the plurality of radiating elements 120 in each first plate 110 may be arranged in four rows and eight columns, namely, in a 4×8 matrix. However, the interval d1 in the horizontal direction and the interval d2 in the vertical direction of the plurality of radiating elements 120 and a matrix configuration of the plurality of radiating elements 120 may be changed according to performance of an antenna to be designed considering interference of signal waves.

The reception unit 200 is a member capable of receiving a signal from a target, and thus may include a plurality of second plates 210. The second plates 210 may have the same shapes and same sizes as the first plates 110, but embodiments of the disclosure are not limited thereto. For example, the first plates 110 and the second plates 210 may have rectangular shapes of the same size or may have rectangular shapes of different sizes.

The plurality of second plates 210 are vertically located and arranged as sides of a polygon, and thus the plurality of second plates 210 may form a polygon, more specifically, a regular polygon. In other words, a profile of the plurality of second plates 210 may form a polygon, more specifically, a regular polygon. The profile of the plurality of second plates 210 may be a tetragon, a hexagon, an octagon, a decagon, or the like, and the number of sides of the polygon may be changed according to the performance of an antenna to be designed.

According to an embodiment, the profile of the plurality of second plates 210 may be the same as the profile of the plurality of first plates 110. In other words, the polygon formed by the plurality of second plates 210 may have substantially the same shape and substantially the same size as the polygon formed by the plurality of first plates 110.

The profile of the plurality of second plates 210 forms a polygon, so that the reception unit 200 may form a space therein and form a second layer configured with the plurality of second plates 210. The reception unit 200 of the second layer may be spaced apart from the transmission unit 100 of the first layer in a first direction.

According to an embodiment, the reception unit 200 of the second layer may be spaced apart from the transmission unit 100 of the first layer in the vertical direction. In this case, the transmission unit 100 of the first layer may be arranged at a higher location in the vertical direction than the reception unit 200 of the second layer, but embodiments of the disclosure are not limited thereto. For example, the transmission unit 100 of the first layer may be arranged at a lower location in the vertical direction than the reception unit 200 of the second layer. The phased array antenna 10 according to an embodiment of the disclosure includes the transmission unit 100 and the reception unit 200 spaced apart from each other, thereby reducing an effect of interference between transmission and reception signals.

According to an embodiment, the reception unit 200 of the second layer may be arranged to be overlapped by the transmission unit 100 of the first layer in the vertical direction. In other words, as viewed in the direction IV of FIG. 1, the second plates 210 of the reception unit 200 and the first plates 110 of the transmission unit 100 may be arranged at the same location in a circumferential direction.

The second plates 210 and the first plates 110 located on the same vertical plane may be formed as one module as shown in FIGS. 2A through 2C. Accordingly, the phased array antenna 10 may be modularized, and the phased array antenna 10 may be easily configured by arranging a plurality of modules according to the size and profile of the antenna to be designed.

Each of the plurality of second plates 210 may include a plurality of radiating elements 220 apart from each other. In detail, the plurality of radiating elements 220 may be arranged on one surface of the second plate 210 to be apart from one another in the horizontal and vertical directions. In this case, the one surface of the second plate 220, on which the plurality of radiating elements 220 are arranged, may be a surface that faces outside in the radial direction.

Accordingly, the second plate 220 of the reception unit 200 may receive a signal from the outside in the radial direction. Because the plurality of second plates 220 form a polygonal profile and each of the second plates 220 receives a signal in the radial direction, omnidirectional transmission of 360° may be possible. In addition, because only one phased array antenna 10 is needed without requiring a plurality of antenna devices for omnidirectional communication, the efficiency of an arrangement space may be improved.

The plurality of radiating elements 220 may be apart from one another by an interval d3 in the horizontal direction and an interval d4 in the vertical direction. The plurality of radiating elements 220 may form rows and columns by being apart from one another by the interval d3 in the horizontal direction and the interval d4 in the vertical direction. For example, the plurality of radiating elements 220 in each second plate 210 may be arranged in four rows and eight columns, namely, in a 4×8 matrix. However, the interval d3 in the horizontal direction and the interval d4 in the vertical direction of the plurality of radiating elements 220 and a matrix configuration of the plurality of radiating elements 220 may be changed according to performance of an antenna to be designed considering signal waves.

Referring to FIGS. 1 and 4, the circuit unit 400 is a member supplying power to the transmission unit 100 and the reception unit 200 and controlling the supply of power, and thus may include a phase changer or the like. The circuit unit 400 may be arranged in an internal space defined by the transmission unit 100 and the reception unit 200. In other words, the circuit unit 400 may be arranged within the respective polygonal profiles of the transmission unit 100 and the reception unit 200 and may prevent interference with the transmission unit 100 and the reception unit 200. The circuit unit 400 does not need a special space to be arranged outside the transmission unit 100 and the reception unit 200, thereby contributing to a miniaturization of the phased array antenna 10.

The circuit unit 400 may include a plurality of substrates 410 corresponding to the plurality of first plates 110 and the plurality of second plates 210. In other words, when each of the number of first plates 110 and the number of second plates 210 is 10, the number of substrates 410 may be 10. Each of the substrates 410 may include, for example, a power supply for supplying power to each of the first plates 110 and the second plates 210, and a power supply controller for controlling power supply. Accordingly, each of the substrates 410 may control a signal of each of the first plates 110 and each of the second plates 210.

The plurality of substrates 410 may be radially arranged along respective inner sides of the first plates 110 and the second plates 210. In more detail, each of the substrates 410 may be arranged to be adjacent to each of the first plates 110 and each of the second plates 210 inwards in the radial direction. Because the profile of the plurality of first plates 110 and the profile of the plurality of second plates 210 are polygonal, the plurality of substrates 410 may be arranged to be adjacent to the first plates 110 and the second plates 210 inwards in the radial direction and thus may be radially arranged.

Each of the substrates 410 may have a shape that narrows inwards in the radial direction. In other words, an outer width of the substrate 410 in the radial direction may be greater than an inner width of the substrate 410 in the radial direction. Accordingly, the plurality of substrates 410 may be arranged within the first plates 110 and the second plates 210 and also may prevent interference from occurring between the substrates 410.

According to an embodiment, each of the substrates 410 may have a trapezoidal shape that narrows inwards in the radial direction. As each of the substrates 410 has a trapezoidal shape having a side, in particular, a bottom side, the plurality of substrates 410 may form a ring and define a central space 420 surrounded by the substrates 410 at the center of the ring. For example, members commonly usable by the entire phased array antenna 10 including the transmission unit 100 and the reception unit 200, for example, a power supply, a reference signal unit that generates a reference signal, a connector that connects a plurality of transmission units 100 or a plurality of reception units 200, may be arranged within the central space 420. In addition, a known configuration necessary for driving the phased array antenna 10 may be disposed, and a detailed description thereof will be omitted.

Thus, within an internal space of a polygonal profile formed by the transmission unit 100 and the reception unit 200, the circuit unit 400, preferably, the plurality of substrates 410, may be arranged outside the internal space in the radial direction and thus may control the first plates 110 and the second plates 210, respectively, and members commonly required by the entire phased array antenna 10 may be arranged inside the internal space in the radial direction, namely, in a center space formed by the plurality of substrates 410, and thus the phased array antenna 10 may become compact and may optimize a space arrangement.

FIG. 2A is a front view of the region A of FIG. 1, FIG. 2B is a side view of the region A of FIG. 1, and FIG. 2C is a magnified view of a region C of FIG. 2B.

Referring to FIGS. 2A through 2C, the phased array antenna 10 according to an embodiment of the disclosure may further include an isolation unit 300.

In antennas including the transmission unit 100 and the reception unit 200 separated from each other, even when transmission and reception frequency bands are separated from each other, interference of signals due to a close distance therebetween may occur.

The isolation unit 300 is a member for isolating the transmission unit 100 from the reception unit 200, and thus may include a plurality of third plates 310. Each of the plurality of third plates 310 may have, but is not limited to, a rectangular shape. The isolation unit 300 may include a plurality of protruding walls 320 protruding from each of the plurality of third plates 310.

The plurality of third plates 310 are vertically located and arranged as sides of a polygon, and thus the plurality of third plates 310 may form a polygon, more specifically, a regular polygon. In other words, a profile of the plurality of third plates 310 may form a polygon, more specifically, a regular polygon. The profile of the plurality of third plates 310 may be a tetragon, a hexagon, an octagon, a decagon, or the like, and the number of sides of the polygon may be changed according to the performance of an antenna to be designed.

According to an embodiment, the profile of the plurality of third plates 310 may be the same as a profile of the plurality of first plates 110 and the plurality of second plates 210. In other words, the polygon formed by the plurality of third plates 310 may have substantially the same shape and substantially the same size as a polygon formed by the plurality of first plates 110 and the plurality of second plates 210.

The profile of the plurality of third plates 310 forms a polygon, so that the isolation unit 300 may form a space therein and form a third layer configured with the plurality of third plates 310.

The isolation unit 300 of the third layer may be arranged between the transmission unit 100 of the first layer and the reception unit 200 of the second layer. In more detail, the third plates 310 may be arranged between the first plates 110 and the second plates 210. The transmission unit 100 and the reception unit 200 may be isolated from each other by the isolation unit 300 and may include a high isolation degree by increasing an electrical length due to the protruding walls 320 to be described later, and may minimize interference of a signal reducing the gain of an antenna.

The third plates 310 may be arranged to be substantially continuous with the first plates 110 and the second plates 210. In other words, the first, second, and third plates 110, 210, and 310 may be arranged on substantially the same vertical plane. Accordingly, the first plate 110, the second plate 210, and the third plate 310 may be aligned with one another to thereby improve the stability of a structure and form a phased array antenna 10 with an efficient volume.

According to an embodiment, the isolation unit 300 of the third layer may be arranged to overlap the transmission unit 100 of the first layer and the reception unit 200 of the second layer in the vertical direction. In other words, as viewed in the direction IV of FIG. 1, the second plates 310 of the reception unit 300, the first plates 110 of the transmission unit 100, and the second plates 210 of the reception unit 200 may be arranged at the same location in the circumferential direction. In this case, the second plates 310, the first plates 110, and the second plates 210 located on the same vertical plane may be formed as one module as shown in FIGS. 2A through 2C. Accordingly, the phased array antenna 10 may be modularized, and the phased array antenna 10 may be easily configured by arranging a plurality of modules according to the size and profile of the antenna to be designed.

The plurality of protruding walls 320 of the isolation unit 300 may be formed by protruding from each of the third plates 310 outwards in the radial direction. According to an embodiment, a protruding wall 320 may protrude toward the outside in the radial direction by a protrusion length e1, and may extend from one end of each of the third plates 310 in the horizontal direction to the other end thereof in the horizontal direction. In this case, the plurality of protruding walls 320 may be formed to be apart from one another by a separation distance e2 in a vertical direction in each of the third plates 310. Accordingly, the occurrence of self-interference of the transmission unit 100 due to a surface current heading toward the reception unit 200 may be reduced by suppressing the surface current heading toward the reception unit 200.

According to an embodiment, the plurality of protruding walls 320 may have different protrusion lengths e1. In more detail, the plurality of protruding walls 320 may have preset different protrusion lengths e1 so that destructive interference occurs between signal waves of the transmission unit 100 heading toward the reception unit 200 to minimize interference between the transmission unit 100 and the reception unit 200.

According to an embodiment, the plurality of protruding walls 320 may have different protrusion lengths e2. In more detail, the plurality of protruding walls 320 may have preset different protrusion lengths e2 so that destructive interference between signal waves of the transmission unit 100 heading toward the reception unit 200 occurs to minimize interference between the transmission unit 100 and the reception unit 200.

Referring back to FIG. 1, the phased array antenna 10 may further include a radome 500 that accommodates the transmission unit 100 and the reception unit 200.

The radome 500 may form an outer body of the phased array antenna 10 and may transmit a signal. According to an embodiment, the radome 500 may have a cylinder shape to cover the transmission unit 100 and the reception unit 200. In this case, the radome 500 may have curved edges. The radome 500 may be integrally formed. Accordingly, the radome 500 may protect the phased array antenna 10 from external wind pressure and transmit the signal while suppressing reflection of the signal.

Figure 5:
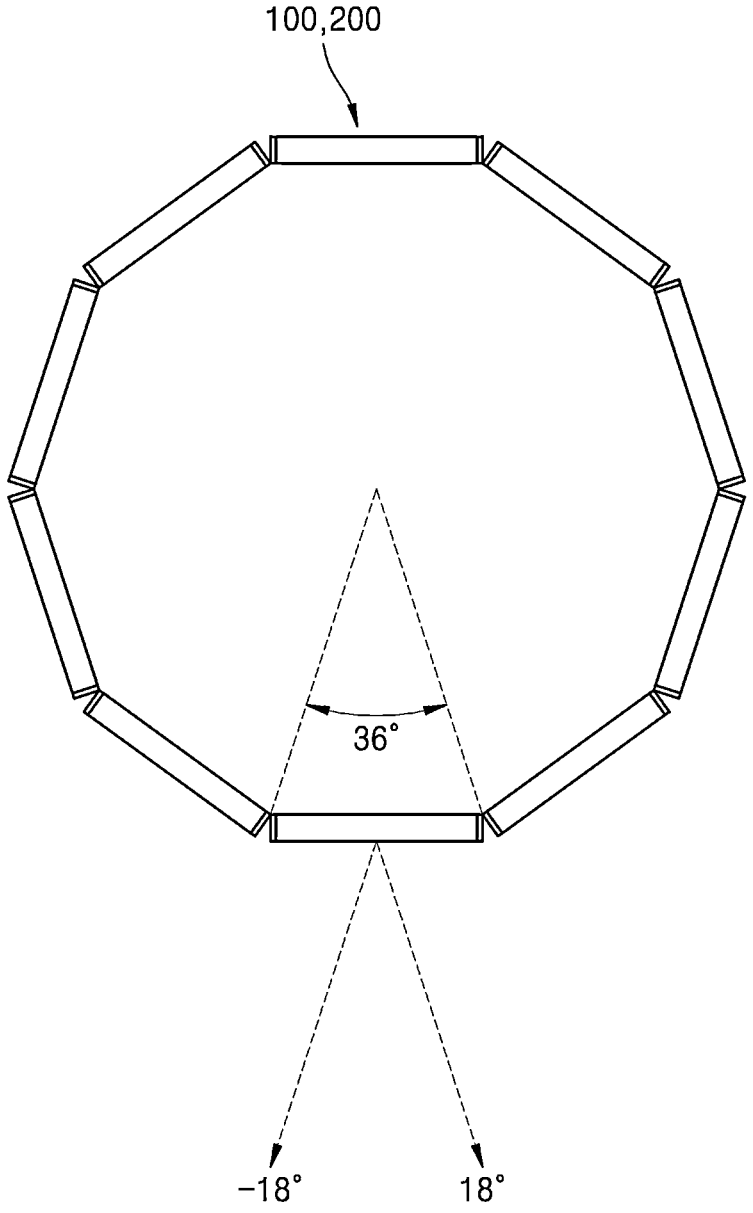
FIG. 5 is a plan view of an orientation range of the phased array antenna according to an embodiment of the disclosure.
Figure 6A:
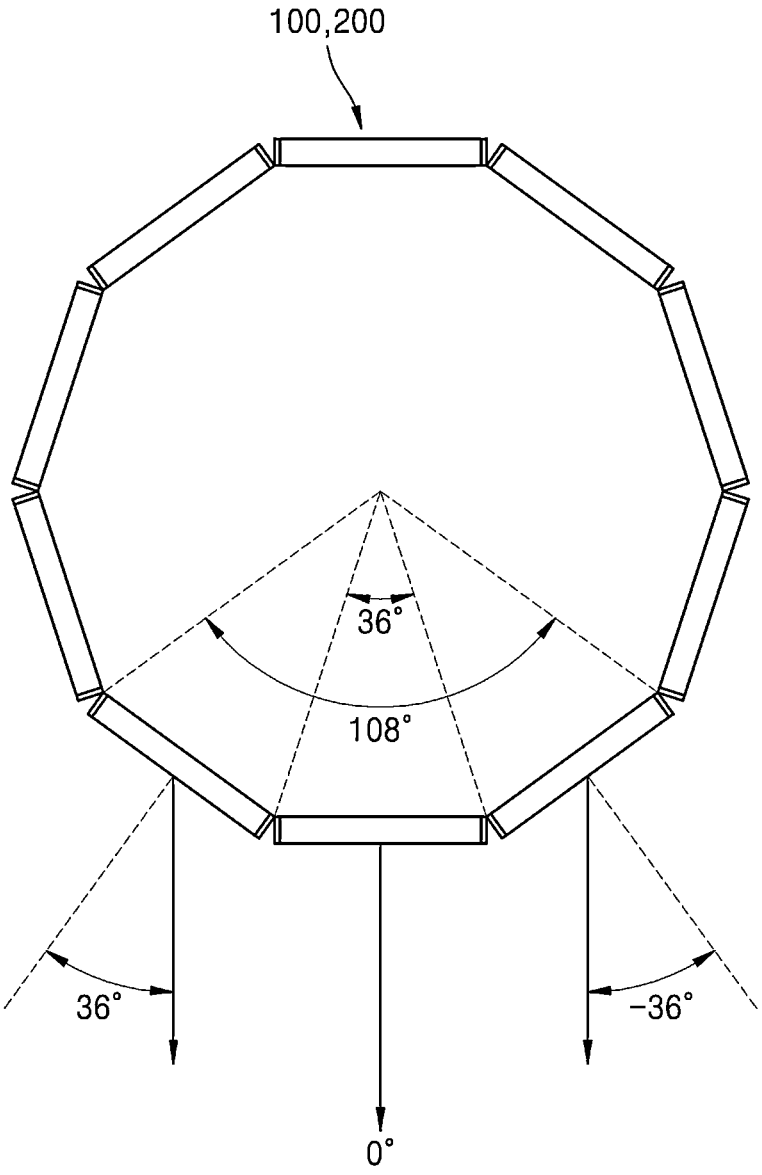
FIGS. 6A, 6B, and 6C are plan views illustrating beam orientation using adjacent plates in the phased array antenna according to an embodiment of the disclosure.
Figure 6B:
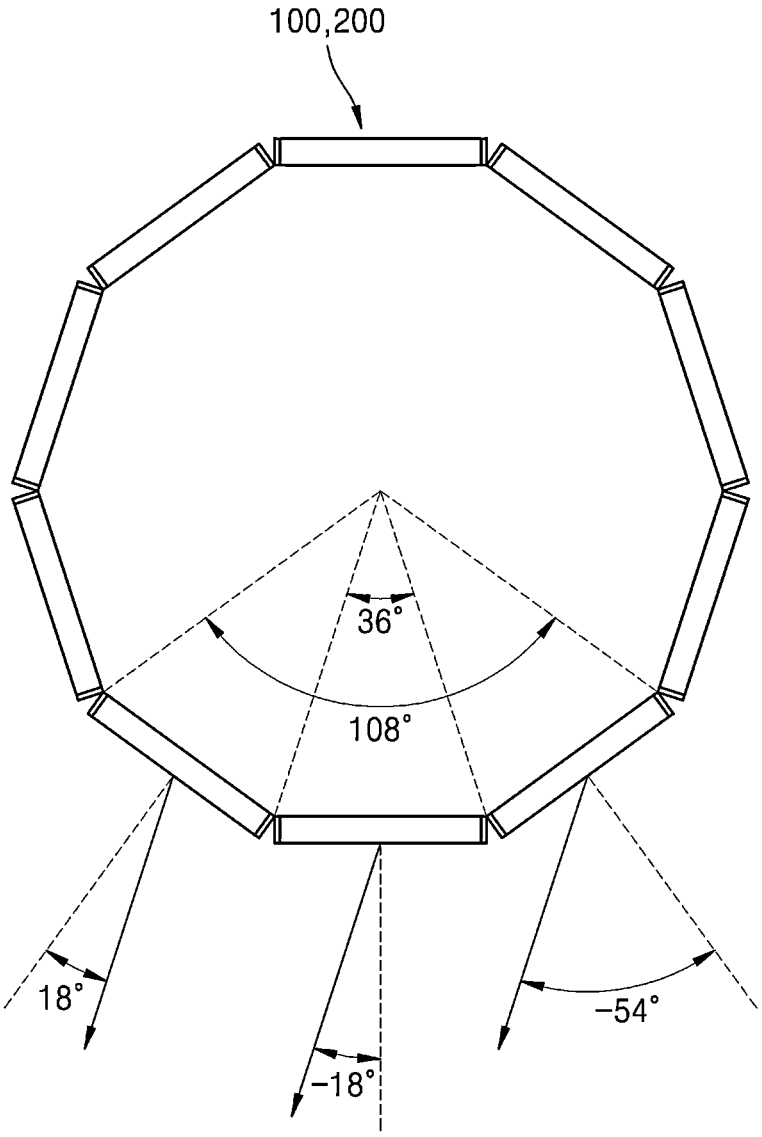
Figure 6C:
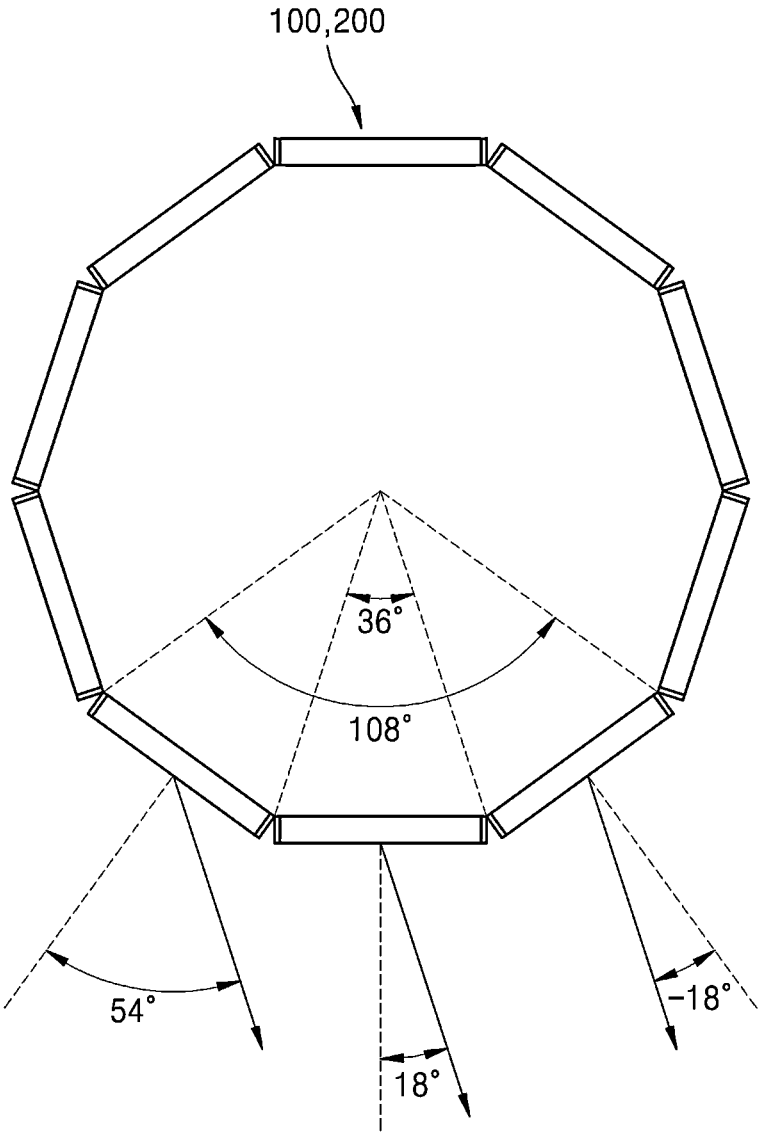

FIG. 5 is a plan view illustrating an orientation range of the phased array antenna 10 according to an embodiment of the disclosure, and FIGS. 6A, 6B, and 6C are plan views illustrating beam orientation using adjacent plates in the phased array antenna 10 according to an embodiment of the disclosure.

Referring to FIG. 5, the transmission unit 100 of the phased array antenna 10 may include a plurality of first plates 110, and a profile of the plurality of first plates 110 may form a polygon. FIG. 5 and FIGS. 6A through 6C illustrate that the plurality of first plates 110 form a regular decagon, and the transmission unit 100 will now be described as an example based on the illustration of FIGS. 5 and FIGS. 6A through 6C, but embodiments of the disclosure are not limited thereto.

Each of the first plates 110 of the transmission unit 100 may cover a beam steering range of 360/n° (where n indicates the number of sides of a polygon). For example, in FIG. 5, each of the first plates 110 covers a beam steering range of 36°. Because each of the first plates 110 covers a beam steering range of 36°, the phased array antenna 10 including the plurality of first plates 110 arranged to form a polygon may cover all directions corresponding to 360°.

Referring to FIGS. 6A through 6C, a first plate 110 may be oriented toward a beam in the same direction by using an adjacent first plate 110 to thereby increase a gain of the antenna.

For example, in FIG. 6A, a center first plate 110 may be oriented toward a beam at an angle of 0° with respect to a line perpendicular to a surface of the center first plate 110. In this case, left and right first plates 110 adjacent to the center first plate 110 may be oriented toward a beam at angles of 36° and −36° with respect to lines perpendicular to respective surfaces of the left and right first plates 110, thereby improving beam directivity with respect to the same direction and increasing the antenna gain.

FIGS. 6B and 6C illustrate cases where the center first plate 110 is oriented toward a beam at angles of −18° and 18° with respect to lines perpendicular to the surface of the center first plate 110, respectively. Likewise, the left and right first plates 110 adjacent to the center first plate 110 may be oriented toward a beam at angles of 18° and 54° or angles of 54° and −18° with respect to lines perpendicular to respective surfaces of the left and right first plates 110, thereby improving beam directivity with respect to the same direction and increasing the antenna gain.

Figure 7:
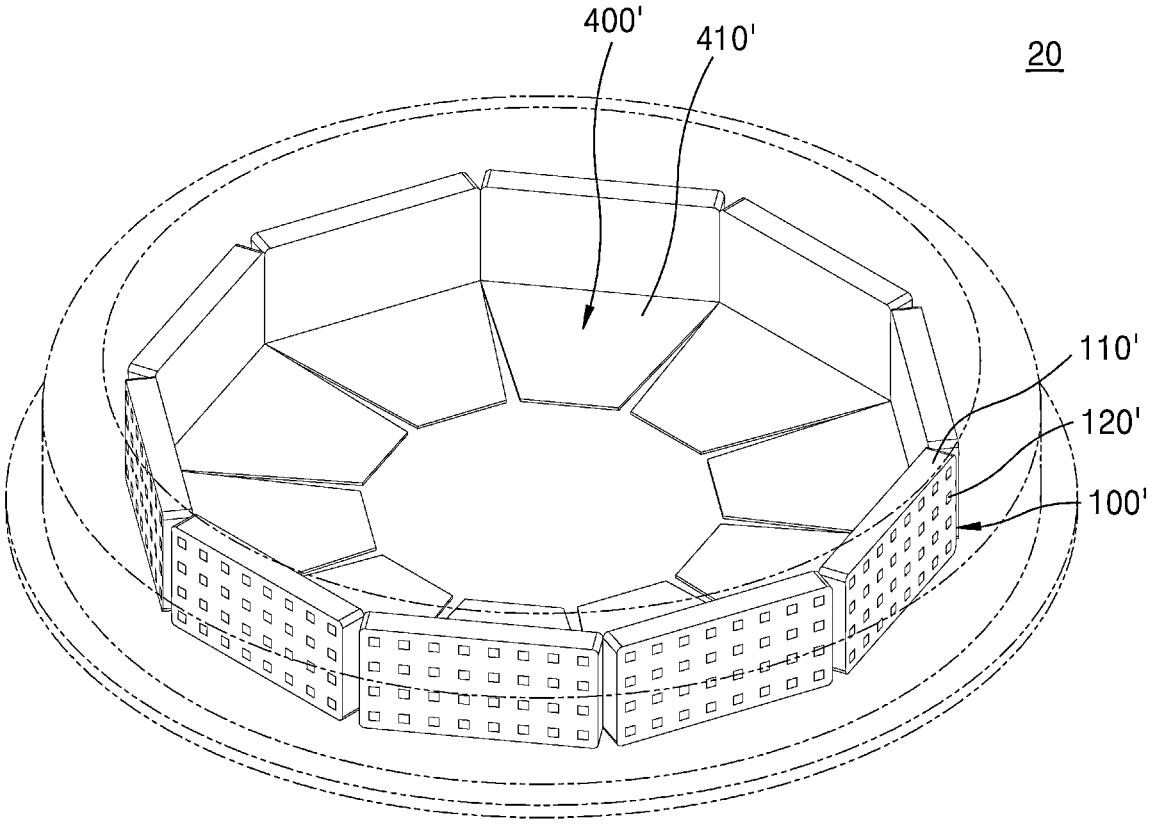
FIG. 7 is a perspective view of a phased array antenna according to another embodiment of the disclosure.
Figure 8:
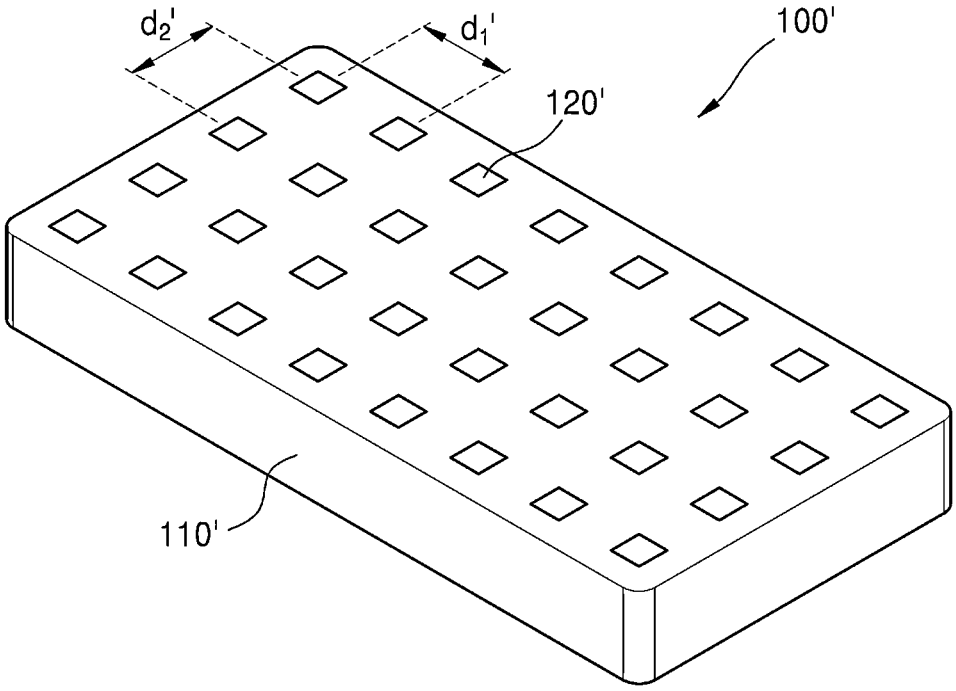
FIG. 8 is a perspective view of a transceiving unit according to another embodiment of the disclosure.

FIG. 7 is a perspective view of a phased array antenna 20 according to another embodiment of the disclosure, and FIG. 8 is a perspective view of a transceiving unit 100' according to another embodiment of the disclosure.

Referring to FIG. 7, the phased array antenna 20 may include the transceiving unit 100' and a circuit unit 400'.

In a multi-communication method, a frequency division communication method, which is a communication method for separating frequencies for transmission and reception, and a time division communication method, which is a method for separating a time interval for transmission and reception, are common. The phased array antenna 20 of FIG. 7 is a time division communication method, and thus may have a shape in which the transmission unit 100 and the reception unit 200 are integrally formed with each other. Differences from the above-described embodiment will now be focused on and described.

In contrast with the phased array antenna 10 according to the above-described embodiment, the phased array antenna 20 according to the present embodiment may include the transceiving unit 100' obtained by integrally forming the transmission unit 100 with the reception unit 200. In other words, in the phased array antenna 20, the transmission unit 100 and the reception unit 200 may not be arranged to be spaced apart from each other but may be integrally formed with each other.

The transceiving unit 100' is a member capable of transmitting a signal to a target and receiving a signal from the target, and thus may include a plurality of fourth plates 110'. Each of the plurality of fourth plates 110' may have, but is not limited to, a rectangular shape. According to an embodiment, the fourth plate 110' may be a reflective plate, and may reflect a signal to be oriented toward a beam in a specific direction.

The plurality of fourth plates 110' are vertically located and arranged as sides of a polygon, and thus the plurality of fourth plates 110' may form a polygon, more specifically, a regular polygon. In other words, a profile of the plurality of fourth plates 110' may form a polygon, more specifically, a regular polygon. The profile of the plurality of fourth plates 110' may be a tetragon, a hexagon, an octagon, a decagon, or the like, and the number of sides of the polygon may be changed according to the performance of an antenna to be designed.

For convenience of explanation, a case where the profile of the plurality of fourth plates 110' is a regular decagon as shown in FIG. 7 will now be focused on and described.

The profile of the plurality of fourth plates 110' forms a polygon, so that the transceiving unit 100' may form a space therein and form a fourth layer configured with the plurality of fourth plates 110'. Here, forming a layer means that plates on the same layer are arranged to be at the same level.

Referring to FIG. 8, each of the plurality of fourth plates 110' may include a plurality of radiating elements 120' apart from each other. In detail, the plurality of radiating elements 120' may be arranged on one surface of the fourth plate 110' to be apart from one another in the horizontal and vertical directions. In this case, the one surface of the fourth plate 110', on which the plurality of radiating elements 120' are arranged, may be a surface that faces outside in the radial direction.

Accordingly, the fourth plate 110' of the transceiving unit 100' may transmit and receive a signal toward and from the outside in the radial direction. Because the plurality of fourth plates 110' form a polygonal profile and each of the fourth plates 110' transmits and receives a signal toward and from the outside in the radial direction, omnidirectional transmission of 360° may be possible.

The plurality of radiating elements 120' may be apart from one another in an interval d1' in the horizontal direction and an interval d2' in the vertical direction. However, the interval d1' in the horizontal direction and the interval d2' in the vertical direction of the plurality of radiating elements 120' and a matrix configuration of the plurality of radiating elements 120' may be changed according to performance of an antenna to be designed considering the interference of signal waves.

The circuit unit 400' may be arranged in an internal space defined by the transceiving unit 100'. In other words, the circuit unit 400' may be arranged within the polygonal profile of the transceiving unit 100' and may prevent interference with the transceiving unit 100'. The circuit unit 400' does not need a special space to be arranged outside the transceiving unit 100', so that the phased array antenna 20 may become compact.

The circuit unit 400' may include a plurality of substrates 410' corresponding to the plurality of fourth plates 110'. The plurality of substrates 410' may be radially arranged along respective inner sides of the fourth plates 110'.

Although the phased array antenna 20 has been briefly described above, it is understood that other configurations of the phased array antenna 10 not described in the present embodiment may be added to the phased array antenna 20.

The disclosure has been described above with reference to the embodiment shown in the drawings, but this is only an example. It will be understood by those skilled in the art that various modifications and equivalent other embodiments are possible from the embodiment. Therefore, the scope of the disclosure should be determined based on the accompanying claims.

Specific technical contents described in the embodiment are embodiments, and do not limit the technical scope of the embodiment. In order to concisely and clearly describe the description of the disclosure, descriptions of conventional general techniques and configurations may be omitted. Furthermore, the connecting lines, or connectors shown in the various figures presented are intended to represent exemplary functional relationships and/or physical or logical couplings between the various elements. It should be noted that many alternative or additional functional relationships, physical connections or logical connections may be present in a practical device. Moreover, no item or component is essential for application of the disclosure unless the item or component is specifically described as "essential" or "critical".

In the description and claims, "above" or similar referents may refer to both the singular and the plural unless otherwise specified. Furthermore, recitation of ranges of values herein are merely intended to serve as a shorthand method of referring individually to each separate value falling within the range, unless otherwise indicated herein, and each separate value is incorporated into the specification as if it were individually recited herein. The operations that constitute a method described herein can be performed in any suitable order unless otherwise indicated herein or otherwise clearly contradicted by context. Embodiments are not limited to the described order of the operations. The use of any and all examples, or exemplary language (e.g., "such as") provided herein, is intended merely to better illuminate the disclosure and does not pose a limitation on the scope of the disclosure unless otherwise claimed. Numerous modifications and adaptations will be readily apparent to one of ordinary skill in the art in accordance with design conditions and factors without departing from the spirit and scope of the disclosure.

A phased array antenna according to an embodiment of the disclosure includes a transmission unit and a reception unit of which a profile forms a polygon, thus enabling formation of an omnidirectional communication beam, may become compact and light, and may increase a gain due to simultaneous utilization of the transmission unit and the reception unit adjacent to each other.

The phased array antenna according to an embodiment of the disclosure further includes an isolation unit having a polygonal profile, and the isolation unit includes a plurality of protruding walls and thus antenna isolation of the transmission unit and the reception unit may be improved.

The phased array antenna according to an embodiment of the disclosure includes a circuit unit arranged in an internal space defined by the transmission unit and the reception unit, so that the circuit unit may be arranged without interference with the transmission unit and the reception unit and the antenna may become compact and light.

In the phased array antenna according to an embodiment of the disclosure, the circuit unit is arranged in a ring shape to define a central space, and thus, a power supply and the like may be arranged within the central space, enabling efficiency of a space.

A phased array antenna according to another embodiment of the disclosure includes a transceiving unit having a polygonal profile to form an omnidirectional communication beam, and includes a circuit unit arranged in an internal space defined by the transceiving unit, so that the circuit unit may be arranged without interference with the transceiving unit, and the antenna may become compact and light.

The effects of the disclosure are not limited to the above-mentioned effects, and other effects not mentioned will be clearly understood by a person skilled in the art from the accompanying claims.

It should be understood that embodiments described herein should be considered in a descriptive sense only and not for purposes of limitation. Descriptions of features or aspects within each embodiment should typically be considered as available for other similar features or aspects in other embodiments. While one or more embodiments have been described with reference to the figures, it will be understood by those of ordinary skill in the art that various changes in form and details may be made therein without departing from the spirit and scope of the disclosure as defined by the following claims.

What is claimed is:

1. A phased array antenna comprising:

a transmission unit of a first layer including a plurality of first plates having a polygonal profile;

a reception unit of a second layer including a plurality of second plates having a polygonal profile, the reception unit being spaced apart from the transmission unit in a first direction;

an isolation unit of a third layer including a plurality of third plates having a polygonal profile, arranged between the transmission unit and the reception unit, and including a plurality of protruding walls; and a circuit unit arranged within an internal space defined by the transmission unit and the reception unit, wherein the plurality of first plates are arranged as sides of a regular polygon so that the plurality of first plates form a regular polygon, the plurality of second plates are arranged as sides a regular polygon so that the plurality of second plates form a regular polygon, and the plurality of third plates are arranged as sides a regular polygon so that the plurality of third plates form a regular polygon, wherein the first plate, the second plate and the third plate are arranged on a same vertical plane, wherein each of the protruding walls is protruded from the third plate on the vertical plane and is extended from one end to another end of the third plate in a second direction so that a cross section of the each of the protruding walls is rectangular in a plane view.

2. The phased array antenna of claim 1, wherein each of the plurality of first plates and the plurality of second plates includes a plurality of radiating elements apart from one another.

3. The phased array antenna of claim 1, wherein the plurality of protruding walls have different protrusion lengths from one another.

4. The phased array antenna of claim 1, wherein the plurality of protruding walls have different separation distances from one another.

5. The phased array antenna of claim 1, wherein the circuit unit includes a plurality of substrates corresponding to the plurality of first plates and the plurality of second plates, and the plurality of substrates are radially arranged along respective inner sides of the plurality of first plates and the plurality of second plates.

6. The phased array antenna of claim 5, wherein each of the plurality of substrates narrows inwards in a radial direction.

7. The phased array antenna of claim 6, wherein each of the plurality of substrates has a trapezoidal shape that narrows inwards in the radial direction.

8. The phased array antenna of claim 5, wherein the plurality of substrates are arranged in a ring shape to define a central space.

* * * * *